US008257151B2

(12) United States Patent
Pei

(10) Patent No.: US 8,257,151 B2
(45) Date of Patent: Sep. 4, 2012

(54) POLISHING DEVICE

(75) Inventor: Shao-Kai Pei, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 158 days.

(21) Appl. No.: 12/916,603

(22) Filed: Oct. 31, 2010

(65) Prior Publication Data

US 2011/0318998 A1 Dec. 29, 2011

(30) Foreign Application Priority Data

Jun. 24, 2010 (TW) ..... 99120600

(51) Int. Cl.
*B24B 7/00* (2006.01)

(52) U.S. Cl. ..... 451/66; 451/120; 451/210; 451/242; 451/246

(58) Field of Classification Search ..... 451/120, 451/231, 67, 66, 449, 442, 27, 51, 61, 142, 451/388, 342, 210, 242, 246
See application file for complete search history.

(56) References Cited

U.S. PATENT DOCUMENTS

| | | | | |
|---|---|---|---|---|
| 1,879,110 | A * | 9/1932 | Cramer | 451/52 |
| 2,811,995 | A * | 11/1957 | Bremmer | 99/626 |
| 3,855,916 | A * | 12/1974 | Lazzarini | 99/623 |
| 4,795,496 | A * | 1/1989 | Karaki et al. | 134/8 |
| 5,679,061 | A * | 10/1997 | Thielenhaus | 451/51 |
| 5,695,390 | A * | 12/1997 | Mizuno et al. | 451/124 |
| 6,012,973 | A * | 1/2000 | Nagel | 451/51 |
| 6,287,183 | B1 * | 9/2001 | Zhang et al. | 451/407 |
| 6,615,613 | B1 * | 9/2003 | Iwabuchi et al. | 65/61 |
| 2011/0065367 | A1 * | 3/2011 | Pei | 451/233 |

* cited by examiner

*Primary Examiner* — George Nguyen
(74) *Attorney, Agent, or Firm* — Altis Law Group, Inc.

(57) ABSTRACT

A polishing device includes an outer barrel, an inner barrel, polishing members, and an actuator. The outer barrel defines a chamber and includes inner surfaces substantially parallel to a central axis of the outer barrel. Each of the inner surfaces defines a holding groove for holding a workpiece. The inner barrel is received in the chamber and includes a side surface substantially parallel to the central axis. The side surface defines installation grooves. Each polishing member includes an elastic piece, a polishing motor connected to a bottom of a corresponding installation groove by the elastic piece and received in the corresponding installation groove, and a polishing plate connected to the polishing motor and capable of being driven to rotate by the polishing motor. The actuator is configured for driving the outer barrel to spin and move back and forth along the central axis.

14 Claims, 7 Drawing Sheets

POLISHING DEVICE

BACKGROUND

1. Technical Field

The present disclosure relates to polishing devices and, particularly, to a polishing device for polishing multiple workpieces at the same time.

2. Description of Related Art

Current polishing devices generally include a bed with fixture for holding one or more workpieces and a polishing part for polishing the workpieces so that a surface of each of the workpieces is polished to a desired smoothness. To increase efficiency, a large size bed is required to hold many workpieces at the same time. As such, the polishing part can be used to continuously polish the workpieces, or more grinding parts can be employed to grind the workpieces simultaneously. However, the large size bed reduces space usage efficiency.

Therefore, it is desirable to provide a new polishing device, which can overcome the above-mentioned limitations.

DETAILED DESCRIPTION

Figure 1:
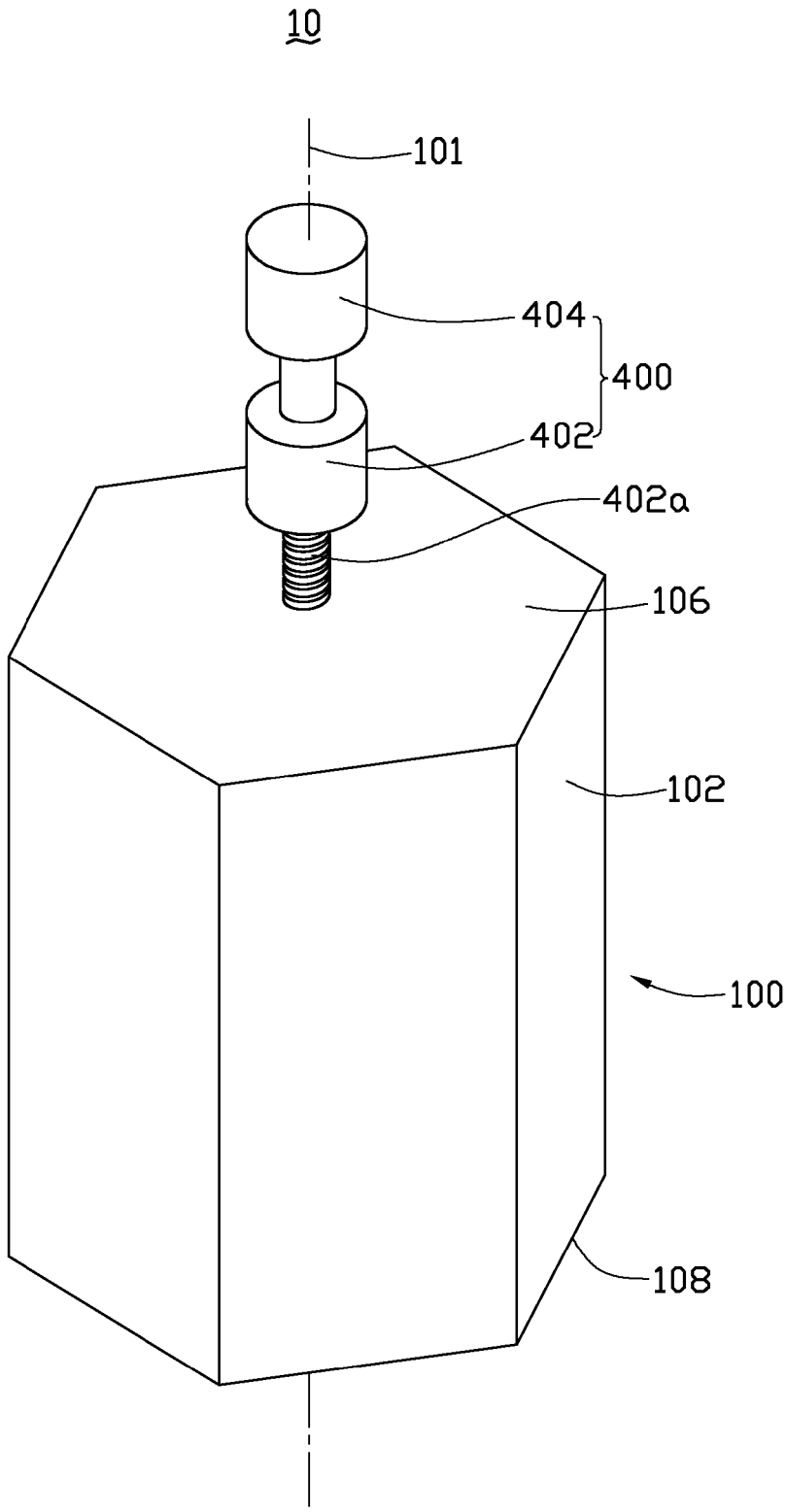
FIG. 1 is an isometric view of a polishing device, according to an exemplary embodiment.
Figure 2:
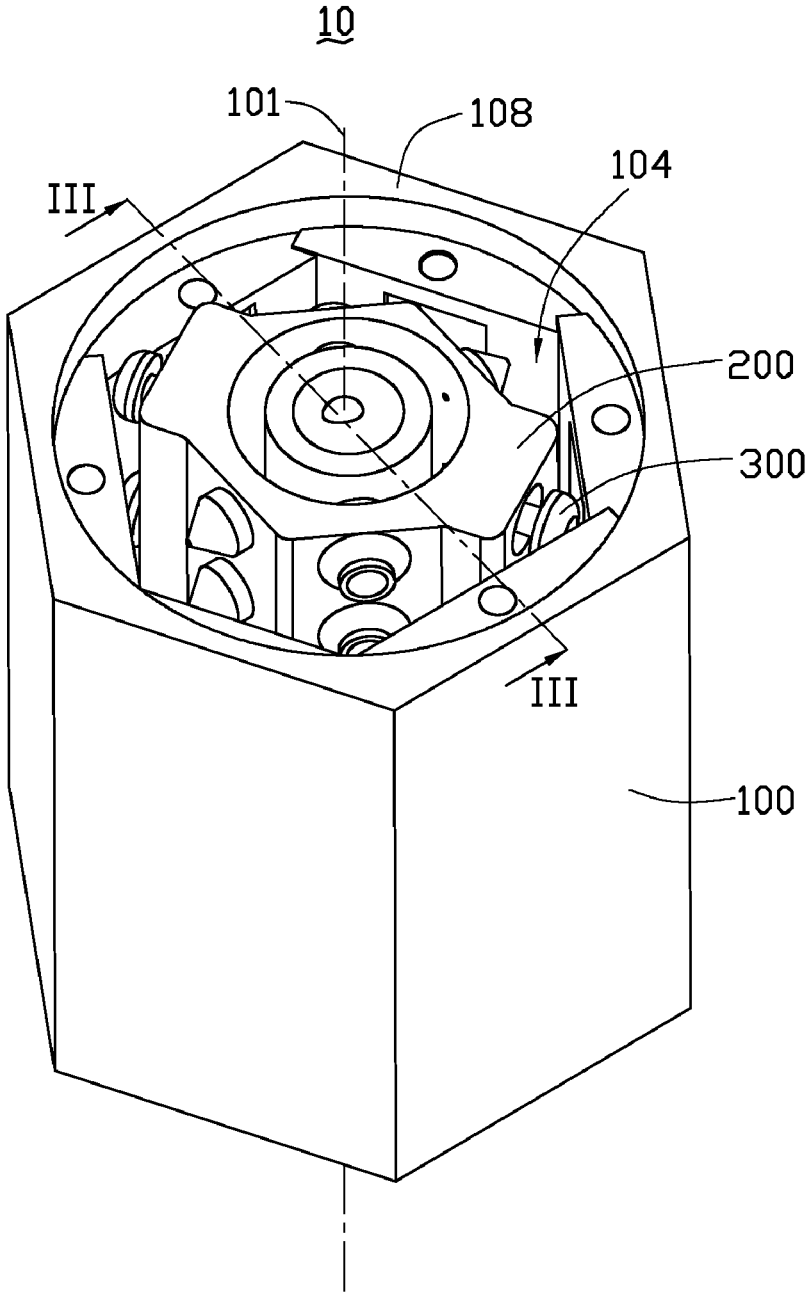
FIG. 2 is similar to FIG. 1, but viewed at another angle.

Referring to FIGS. 1-2, a polishing device 10, according to an exemplary embodiment, includes an outer barrel 100, an inner barrel 200, a number of polishing members 300 (see FIG. 4), and an actuator 400.

Figure 3:
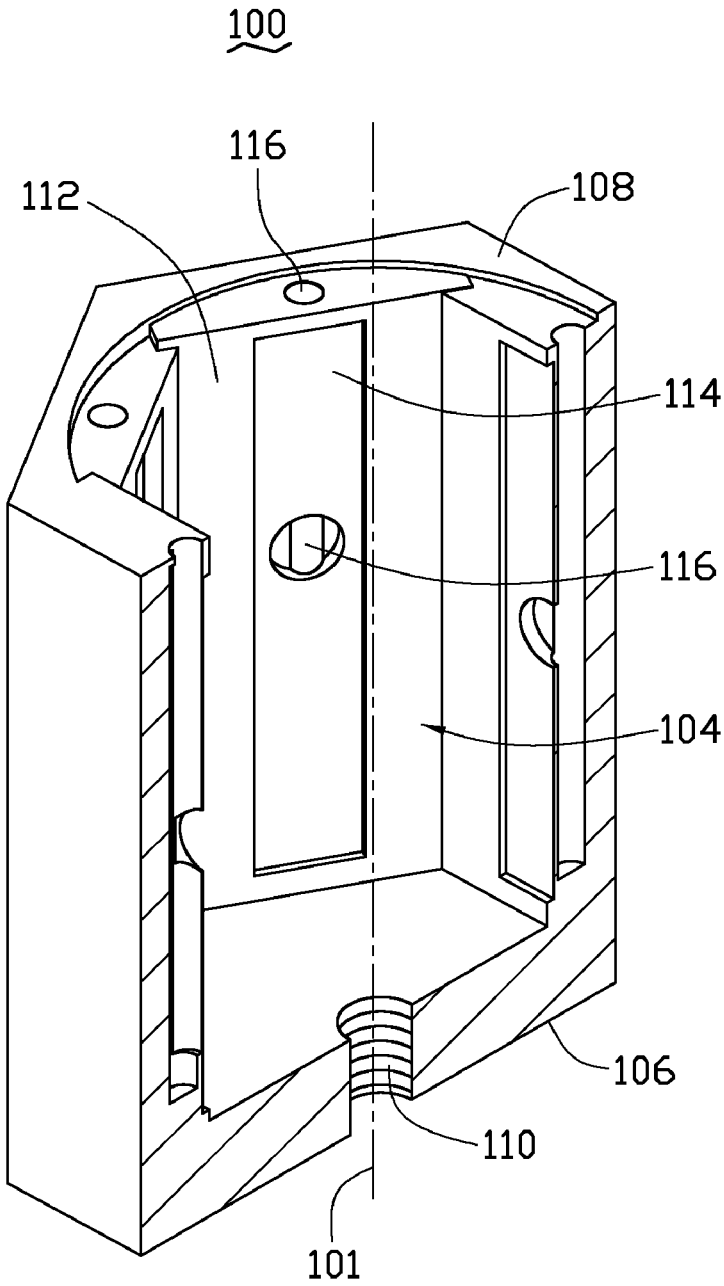
FIG. 3 is an isometric, cross-sectional view of an outer barrel of the polishing device, taken along line III-III of FIG. 2.

Also referring to FIG. 3, the outer barrel 100 includes a first main body 102 which is generally a hexagonal prism shape and is generally symmetrical about a central axis 101 of the outer barrel 100. The first main body 102 includes a top plate 106 and a bottom plate 108.

The first main body 102 defines a substantially hexagonal prism chamber 104 therein which is symmetrical about the central axis 101. The hexagonal prism chamber 104 passes through the bottom plate 108 and is bounded by six inner side surfaces 112 of the first main body 102. Each of the inner side surfaces 112 defines a holding groove 114 therein generally at the center thereof. Each holding groove 114 is configured for holding a workpiece therein and is shaped corresponding to the workpiece. In this embodiment, the holding groove 114 is rectangular and arranged so that the length direction thereof is substantially parallel to the central axis 201. The first main body 102 also defines a number of first suction holes 116 therethrough. Each of the first suction holes 116 communicates a corresponding holding groove 114 with an external vacuum source (not shown) through the bottom plate 108. As such, after a workpiece is placed in a corresponding holding groove 114, the vacuum source is activated to suck the workpiece so that the workpiece is fixedly held by the holding groove 114. The top plate 106 defines a screw hole 110 therethrough generally at the center thereof.

It should be understood that the hexagonal prism chamber 104 is not limited to this embodiment. To reduce or increase the number of the inner side surfaces 112 for holding less or more workpieces, other types of regular prism chamber having less or more inner side surfaces 112 can be employed.

The holding grooves 114 are not limited to this embodiment too. In other alternative embodiments, more holding grooves 114 can be defined in one inner side surface 112 and arranged in other suitable fashions. Also, less holding grooves 114 can be employed and selectively defined in certain portion of the inner side surfaces 112.

It also should be understood that the first suction holes 116 are for fixedly holding the workpieces in the holding grooves 114 and are not limited to this embodiment.

Figure 4:
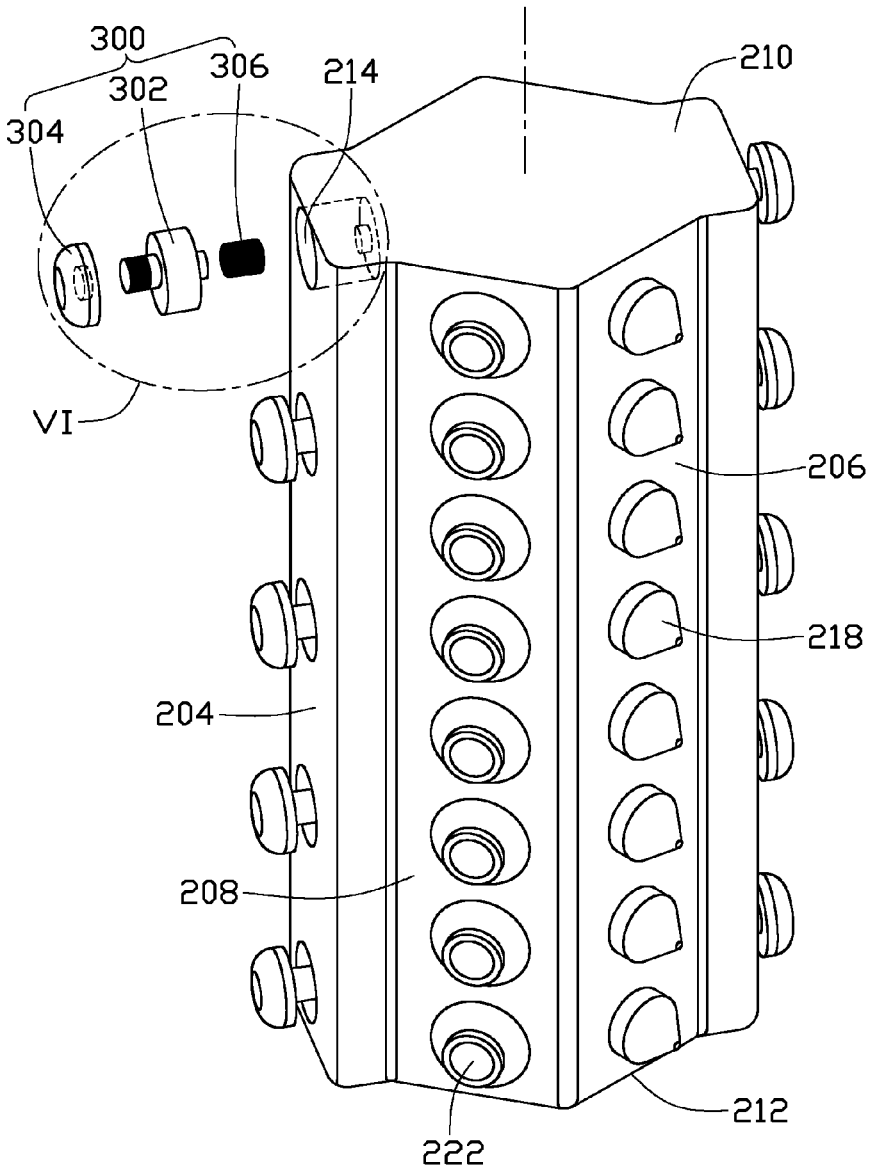
FIG. 4 is an isometric view of an inner barrel and an exploded polishing member of the polishing device of FIG. 1.
Figure 5:
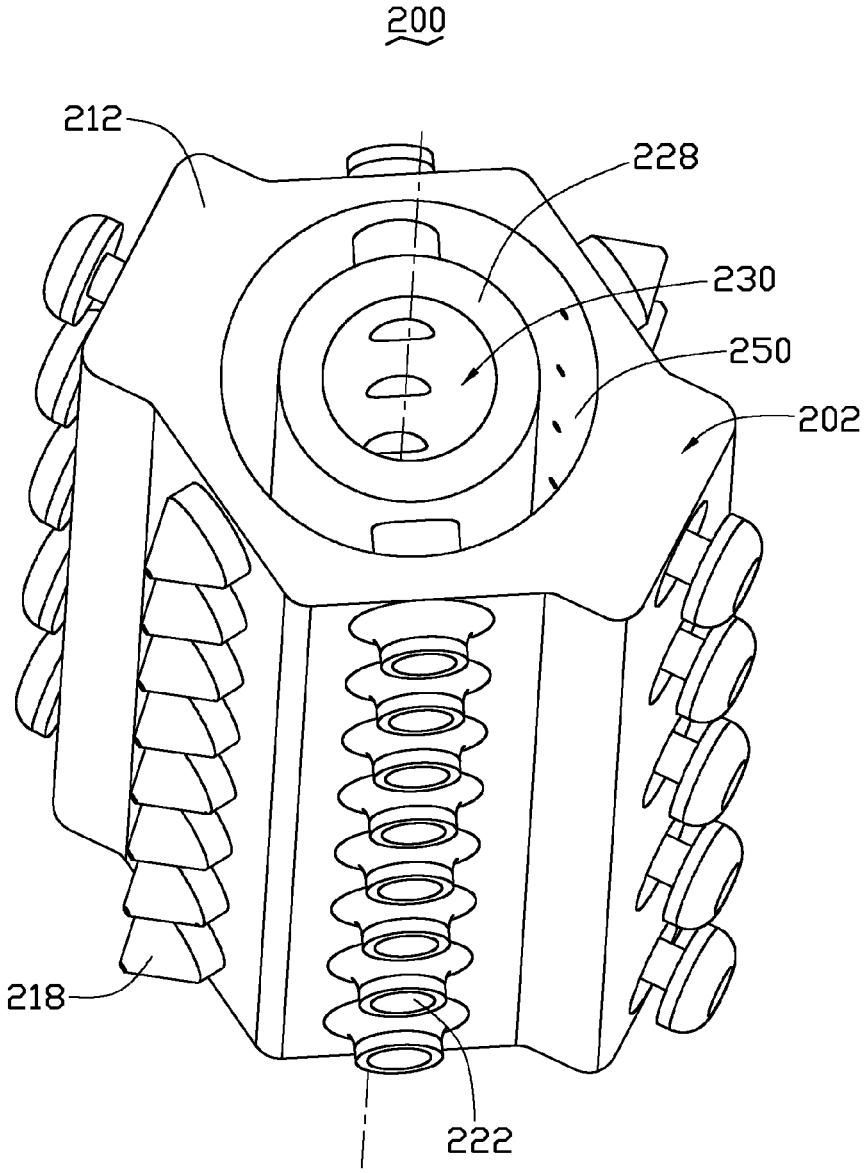
FIG. 5 is similar to FIG. 4, but viewed at another angle.
Figure 6:
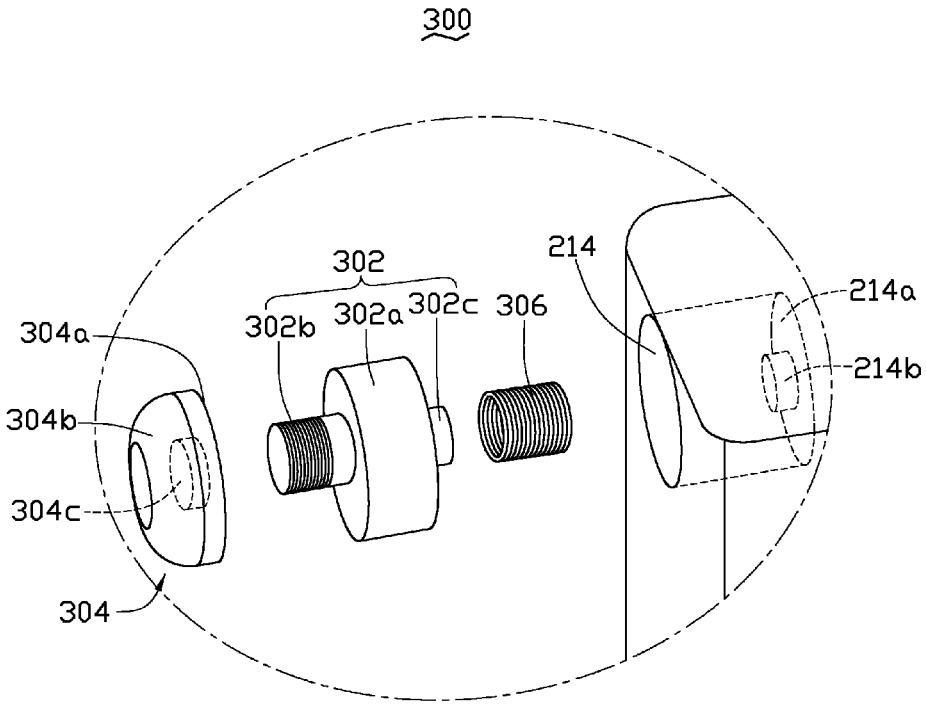
FIG. 6 is an enlarged view of a circled portion VI of FIG. 4.

Also referring to FIGS. 4 through 6, the inner barrel 200 is received within the hexagonal prism chamber 104. The inner barrel 200 includes a second main body 202 that is arranged along the central axis 101. In particular, the second main body 202 is generally a hexagonal prism and includes a top surface 210, a bottom wall 212, two opposite first side surfaces 204, two opposite second side surfaces 206, and two opposite third side surfaces 208.

Each of the first side surfaces 204 defines a number of installation grooves 214 in a line parallel to the central axis 101 generally at the center of the corresponding first side surfaces 204. The installation grooves 214 are shaped corresponding to the polishing members 300 and are cylindrical. Each of the installation grooves 214 includes a bottom wall 214*a*. The bottom wall 214*a* defines a cylindrical fixing shaft 214*b* generally at the center thereof.

It should be understood that the installation grooves 214 are not limited to this embodiment. In other alternative embodiments, more installation grooves 214 can be defined in one first side surface 204 and arranged in other suitable fashions.

The second main body 202 protrudes outwards of a number of water nozzles 218 from each of the second side surfaces 206. The water nozzles 218 are arranged in a line parallel to the central axis 101 generally at the center of the corresponding second side surface 206.

The inner barrel 200 further includes an inner tube 228. The inner tube 228 is received in the second main body 202 and arranged along the central axis 101. The second main body 202 and the inner tube 228 cooperatively define a water chamber 250 therebetween. The water chamber 250 communicates with a water source (not shown). The inner tube 228 defines a grease chamber 230 therein. The grease chamber 230 communicates with a grease source (not shown). The water nozzles 218 communicate with the water chamber 250.

The second main body 202 further protrudes outwards a number of grease nozzles 222 from each of the third side surfaces 208. The grease nozzles 222 are arranged in a line parallel to the central axis 101 generally at the corresponding third side surface 208. The grease nozzles 222 communicate with the grease chamber 230.

Each of the polishing members 300 includes a polishing motor 302, a polishing plate 304 and an elastic piece 306. The polishing motor 302 is connected to the bottom wall 214*a* of the installation grooves 214 by the elastic piece 306 and received in the installation grooves 214. The polishing plate 304 is connected to polishing motor 302 and can be driven to rotate thereby.

In the present embodiment, the polishing motor 302 includes a motor body 302*a*, a threaded shaft 302*b*, and a fastening shaft 302*c*. The motor body 302*a* is cylindrical and is shaped according to the installation groove 214. Thus, the motor body 302 can slide in installation groove 214 along the central axis (not shown) of the installation groove 214. The threaded shaft 302*b* extends outwards from a side of the motor body 302*a*. While the fastening shaft 302*c* protrudes outwards from an opposite side of the motor body 302*a*. The threaded shaft 302*b* can be driven to rotate by the motor body 302*a*. The polishing plate 304 includes a planar surface 304*a* and a curved abrading surface 304*b* opposite to the planar surface 304*a*. The planar surface 304*a* defines a screw groove 304*c* generally at the center thereof. The threaded shaft 302*b* is screwed into the screw groove 304*c* so that the polishing plate 304 can be driven to rotate by the polishing motor 302. The elastic piece 306 is a helical spring and connects the fixing shaft 214*b* of the installation groove 214 with the fastening shaft 302*c*. Therefore, the polishing motor 302 is connected to the bottom wall 214*a* of the installation groove 214 and capable of moving along the axis of the installation groove 214.

Referring back to FIG. 1, the actuator 400 includes a rotating motor 402 and a cylinder 404. The rotating motor 402 includes a threaded rotor 402*a* that is screwed into the screw hole 110 of the outer barrel 100, so that the outer barrel 100 can be driven to rotate by the rotating motor 402. The cylinder 404 is connected to the rotating motor 402 to drive the rotating motor 402 and the outer barrel 100 to move along the central axis 101.

Figure 7:
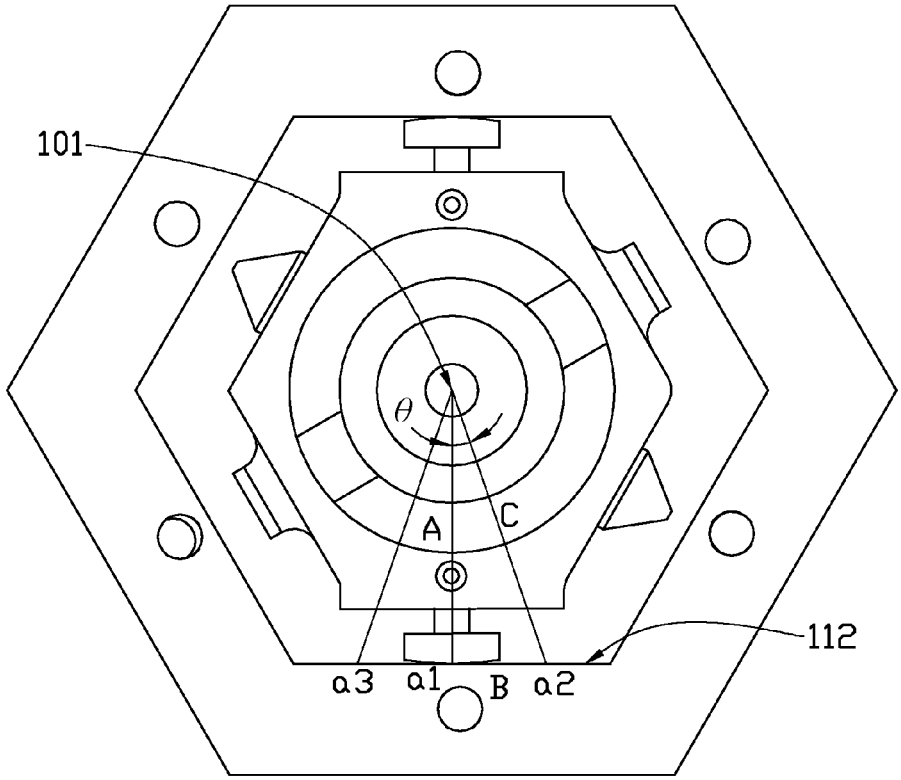
FIG. 7 is a top view of the polishing device of FIG. 1, which is in operation.

Refer to FIG. 7, it is assumed that the mass of the polishing plate 304 is "m", the distance from the center of the workpiece, which is labeled as "a1", to the central axis 101 is "A", the distance from one of the edges of the workpiece, which are labeled as "a2" and "a3", to the central axis 101 is "C", and half the width of the workpiece is "B". Then, "A", "B", and "C" consist a right triangle. In addition, it is assumed that an included angle between "A" and "C" is "θ", a coefficient of elasticity of the elastic piece 306 is "K", and, during rotation of the outer barrel 100, the polishing plate 304 does not contact the workpiece until the center of the polishing plate 304 arrives "a2" or "a3".

In operation, the inner barrel 200 is fixed to a base (not shown). Workpieces each with a planar surface to be polished are fixed in the holding grooves 114. The outer barrel 100 receives the inner barrel 200 and is connected to the actuator 400. Then, the rotating motor 402 and the cylinder 418 drive the outer barrel 100 to spin and move back and forth along the central axis 101. During rotation of the outer barrel 100, when the polishing plate 304 starts contacting "a2" and the outer barrel 100 keeps rotating on, the polishing plate 304 starts polishing the workpiece and is compressed by the workpiece. Meanwhile, the polishing plate 304 is driven to rotate by the polishing motor 302, which improves the polishing efficiency of the polishing device 10. Then, the elastic piece is compressed to a maximum when the polishing plate 304 reaches "a1". At this moment, the counterforce generated by the elastic piece 306 is: $F=K(C-A)$.

The polishing plate 304 departs away from the workpiece at "a3" and then the elastic element restores. The time that the polishing plate 304 rotates from a1 to a3 is: $T=\theta/360Y$, wherein Y represents the rotation rate of the rotating motor 402 satisfies. Assuming that the polishing plate 304 has a speed V when the center of the polishing plate is at "a3", a power that the elastic piece 306 applies to the polishing plate 304 can be calculated by $W=F(C-A)/2=[K(C-A)^2]/2$. The kinetic energy of the polishing plate 304 when it is at "a3" is: $E=mV^2/2$. According to the law of conservation of energy, $W=E$, that is: $[K(C-A)^2]/2=mV^2/2$. Then, $V=(C-A)\sqrt{K/m}$ can be obtained. According to: distance equals to time mount average speed, $TV/2=(C-A)$. Further, we can obtain: $Y=\theta\sqrt{K/M}/180$.

Therefore, it can be designed that the rotation rate of the rotating motor 402 satisfies the formula: $Y=\theta\sqrt{K/m}/180$. Thus, the polishing plate 304 is controlled to polish the workpiece when the polishing plate 304 travels from "a1" to "a3".

The polishing device 10 holds more than one workpiece using three dimension spaces. The area of the ground is saved and therefore is advantageous. Further, under the driving of the polishing motor 302, the rotating polishing plate 304 can polish the workpiece efficiently.

Frictional force is ignored in the above-discussed calculation. Therefore, in practical usage, "Y" should be adjusted based on the value from "$\theta\sqrt{K/m}/180$".

While various exemplary embodiments have been described, it is to be understood that the disclosure is not limited thereto. To the contrary, various modifications and similar arrangements (as would be apparent to those skilled in the art) are intended to also be covered. Therefore, the scope of the appended claims should be accorded the broadest interpretation so as to encompass all such modifications and similar arrangements.

What is claimed is:

1. A polishing device, comprising:

an outer barrel defining a chamber therein and comprising a plurality of inner surfaces, the inner surfaces being substantially parallel to a central axis of the outer barrel, each of the inner surfaces defining a holding groove therein for holding a workpiece;

an inner barrel received in the chamber and comprising a first side surface, the side surface being substantially parallel to the central axis and defining a plurality of installation grooves;

a plurality of polishing members, each of the polishing members installed in a corresponding one of the installation grooves and comprising an elastic piece, a polishing motor connected to a bottom wall of the corresponding installation groove by the elastic piece and received in the corresponding installation groove, and a polishing plate connected to the polishing motor and capable of being rotated by the polishing motor; and an actuator configured for driving the outer barrel to spin with respect to the central axis and move back and forth along the central axis.

2. The polishing device of claim 1, wherein the outer barrel defines a plurality of suction holes, each of the suction holes communicates with a corresponding holding groove.

3. The polishing device of claim 1, wherein the bottom wall of the corresponding installation groove has a cylindrical fixing shaft; the polishing motor comprises a motor body shaped according to and capable of moving along the corresponding installation groove, a threaded shaft extending outwards from a side of the motor body, and a fastening shaft protruding outwards from an opposite side of the motor body; the polishing plate comprises a planar surface and a curved abrading surface opposite to the planar surface, the planar surface defines a screw groove generally at the center thereof, the threaded shaft is screwed into the screw groove; the elastic piece connects the fixing shaft to the fastening shaft.

4. The polishing device of claim 3, wherein the polishing device complies the following formula: $Y=\theta\sqrt{K/m}/180$; and "m" is the mass of the polishing plate, "Y" is the rotation rate of the outer barrel, "K" is the coefficient of elasticity of the elastic piece, "θ" is half an angle between the two lines connecting two opposite edges of the workpiece to the central axis.

5. The polishing device of claim 1, wherein the inner barrel comprises a second side surface substantially parallel to the central axis, the inner barrel defines a water chamber therein for storing water, and protrudes a plurality of water nozzles outwards from the second side surface, the water nozzles communicate with the water chamber.

6. The polishing device of claim 5, wherein the water nozzles are arranged in a line parallel to the central axis.

7. The polishing device of claim 1, wherein the inner barrel comprises a third side surface substantially parallel to the central axis, the inner barrel defines a grease chamber therein for storing grinding grease, and protrudes a plurality of grease nozzles outwards from the third side surface, the grease nozzles communicate with the grease chamber.

8. The polishing device of claim 7, wherein the grease nozzles are arranged in a line parallel to the central axis.

9. The polishing device of claim 1, wherein the inner barrel comprises a main body and an inner tube, the main body comprises the first side surface, a second side surface, and a third side surface, the second side surface and the third side surface are parallel to the central axis, the inner tube is received in the main body, the main body and the inner tube cooperatively defines a water chamber therebetween, the inner tube defines a grease chamber therein, the main body protrudes a plurality of water nozzles outwards from the second side surface and a plurality of grease nozzles outwards from the third side surface, the water nozzles communicate with the water chamber, the grease nozzle communicating the grease chamber.

10. The polishing device of claim 1, wherein the actuator comprises a rotating motor and a cylinder, the rotating motor is connected to the outer barrel and configured for rotating the outer barrel, the cylinder is connected to the rotating motor and configured for driving the outer barrel to move along the central axis.

11. The polishing device of claim 1, wherein the outer barrel is a hexagonal prism shape and symmetrical about the central axis.

12. The polishing device of claim 1, wherein the chamber is a hexagonal prism shape and symmetrical about the central axis.

13. The polishing device of claim 1, wherein the inner barrel is a hexagonal prism shape.

14. The polishing device of claim 1, wherein the installation grooves are arranged in a line parallel to the central axis.

* * * * *